United States Patent [19]

Ali et al.

[11] 4,090,453

[45] May 23, 1978

[54] RERAILING SYSTEM

[75] Inventors: Syed Y. Ali, Chicago; Anthony G. Profet, Wheeling, both of Ill.

[73] Assignee: Templeton, Kenly & Company, Broadview, Ill.

[21] Appl. No.: 714,580

[22] Filed: Aug. 16, 1976

[51] Int. Cl.[2] ..... B61K 13/00

[52] U.S. Cl. ..... 104/273; 104/262

[58] Field of Search ..... 104/262, 272, 273, 7, 104/4, 32, 35, 31, 48; 254/84, 105, 106; 105/177; 308/35

[56] References Cited

U.S. PATENT DOCUMENTS

| | | | |
|---|---|---|---|
| 227,422 | 5/1880 | Flynn | 104/273 |
| 1,536,505 | 5/1925 | Kreuzhage | 104/273 |
| 3,301,611 | 1/1967 | Dunlap | 308/35 |
| 3,640,503 | 2/1972 | Spannlane | 254/84 |
| 3,659,823 | 5/1972 | Griffin | 254/105 |
| 3,828,689 | 8/1974 | Raffenberg | 104/273 |
| 3,991,889 | 11/1976 | Cox | 104/32 R |
| 4,030,699 | 6/1977 | Heimke | 254/108 |

FOREIGN PATENT DOCUMENTS

| | | | |
|---|---|---|---|
| 1,159,359 | 6/1958 | France | 104/32 A |
| 1,530,303 | 11/1969 | Germany. | |

*Primary Examiner*—Drayton E. Hoffman
*Assistant Examiner*—Carl Rowold
*Attorney, Agent, or Firm*—Neuman, Williams, Anderson & Olson

[57] ABSTRACT

Apparatus for rerailing derailed wheels of a railway vehicle includes a bridge which is positioned beneath a derailed vehicle end. After the vehicle is leveled, a lifting jack disposed on a carriage mounted on the bridge supportingly elevates the derailed vehicle end and moves the supported derailed end over the rails, the bridge being positioned to return the derailed vehicles to a position over the rails. Since the wheels of the opposed vehicle end are stationary, the derailed vehicle end is moved along an arcuate path. A motive means such as a jack moves the carriage along the bridge axis, and supporting roller means on the carriage enable the lifting jack engaging the vehicle to move transversely to the bridge axis thereby allowing the jack and supported vehicle end to traverse an arcuate path while fully supported.

14 Claims, 12 Drawing Figures

10
10

RERAILING SYSTEM

The invention relates to apparatus for rerailing derailed railway vehicles and more particularly pertains to apparatus which may be manually placed in operative position in a minimum amount of time and with a minimum expenditure of effort.

Rerailing apparatus of various types have been employed in the railway art previously. Thus, Abel U.S. Pat. No. 1,720,111 discloses apparatus for resetting railway vehicles on rails in which the power source of the derailed engine or of an auxiliary train may be employed to provide lifting and shifting of the derailed vehicle over a rail bridge onto the rails with the assistance of a power transformer. The Abel invention comprises the power transformer in which the low air pressures generated by a railway vehicle are converted into necessary high pressures for effecting the necessary vehicle movement.

Robertson U.S. Pat. No. 3,362,351 discloses rerailing apparatus in which a plurality of bed plates disposed between the rails of a railway track has a lifting jack centrally disposed thereof. The jack supports a saddle for engaging the truck of a railway vehicle. The jacks are movable between the tracks for purposes of effecting desired rotation of the supported saddle and vehicle truck.

Raffenberg U.S. Pat. No. 3,828,689 discloses a device for rerailing rail vehicles in which support trucks supporting the elevated derailed end of a railway vehicle by means of a hoist are moved along a bridge until disposed over the tracks whereafter the derailed truck is lowered. In accordance with the Raffenberg invention, the truck-supporting hoist is mounted on a plate supported on the movable truck and is adapted to rotatably move on the truck as well as laterally move, while advancing over the bridge. The movements are intended to react to the forces imparted to such hoist as the hoist-supported vehicle truck is returned to desired position over the track rails. Lateral and rotational movement of the hoist-supporting plate is intended to be assisted by a lubricant film which is forced therebeneath to permit the desired plate movement with a minimum of frictional resistance. The coefficient of friction between the movable and support plates in the Raffenberg device is of the order of 0.1 to 0.2.

In accordance with the hereinafter-described invention, rerailing apparatus is provided comprising a carriage adapted to support a railway car-elevating jack. The carriage is movable along a bridge over which the carriage is movable for carrying the truck of an elevated, derailed railway vehicle into overlying relation with railway tracks to which the derailed truck is to be returned. The truck is then lowered by the jack for rerailing purposes.

Since in the normal rerailing procedure of this type only one vehicle end is moved during a specific rerailing step, it is seen that the opposed vehicle end should be stationary, and preferably the truck wheels thereof are blocked, to insure the absence of movement thereof while the opposed end is carried transversely to the tracks for rerailing purposes. Since the vehicle, which may be a 50-foot long box car, is, in fact, pivoting about the stationary truck as a pivot point while the opposed end is carried, it is apparent that the supported vehicle end being rerailed is, in fact, moved through an arc necessitating lateral movement of the lifting jack on the carriage to prevent tilting and side-loading of the piston of the jack supporting the derailed vehicle end. The lateral displacement is readily effected on the provided apparatus by mounting the supporting jack on a plurality of rollers supported on said carriage for rotational movement along axes parallel to the direction of carriage movement. Thus, upon the exertion of a lateral force component on the jack as it moves along an arcuate path dictated by the box car length and pivot point, the jack readily moves over the rollers with a minimum of frictional resistance.

It is an object of this invention therefore to provide a rerailing apparatus in which tilting of the supporting jack and side loading of the jack piston or ram is eliminated by virtue of a novel roller support for the jack mounted on a movable carriage.

It is another object of this invention to provide a rerailing apparatus which is relatively light in weight, although sturdy in construction, and able to lift the heaviest railway vehicle for rerailing purposes.

It is a further object of this invention to provide a rerailing apparatus employing a carriage in which the supporting trucks thereof adapted to move over a bridge may pivot relative to the supported carriage body, thereby assuring truck contact with the bridge surface even during bridge flexing resulting from a supported load.

It is another object of this invention to provide a rerailing apparatus in which the low frictional resistance encountered by the supporting jack mounted on the provided carriage by virtue of a novel roller support enables the jack to readily move laterally on said carriage so as to provide optimum support in the complete absence of side loading of the jack ram or support piston and resulting jack damage.

It is still another object of this invention to provide a rerailing system employing support rollers which enable ready lateral movement of a supported jack while requiring a minimum of maintenance and no lubricating medium for friction-reducing purposes.

The above and other objects of this invention will become apparent from the following description when read in the light of the accompanying drawing and the appended claims.

In one embodiment of the provided invention, a support carriage is constructed for guided movement over an extruded aluminum support bridge. The carriage has a central support section on which rollers are mounted with the axes thereof parallel to the carriage axis of movement. A jack or rerailing cylinder resting on these rollers is readily movable thereover with a minimum of friction. The coefficient of friction effected between the jack and the carriage rollers is normally of the order of 0.05. Accordingly, when employing the provided apparatus, the supporting jack may readily move transversely to the direction of carriage movement while simultaneously moving axially with the carriage as the jack and supported railway vehicle end portion describe a large-radius arc in the process of the vehicle end being returned to the rails.

For a more complete understanding of this invention reference will now be made to the drawings in which.

Figure 11:
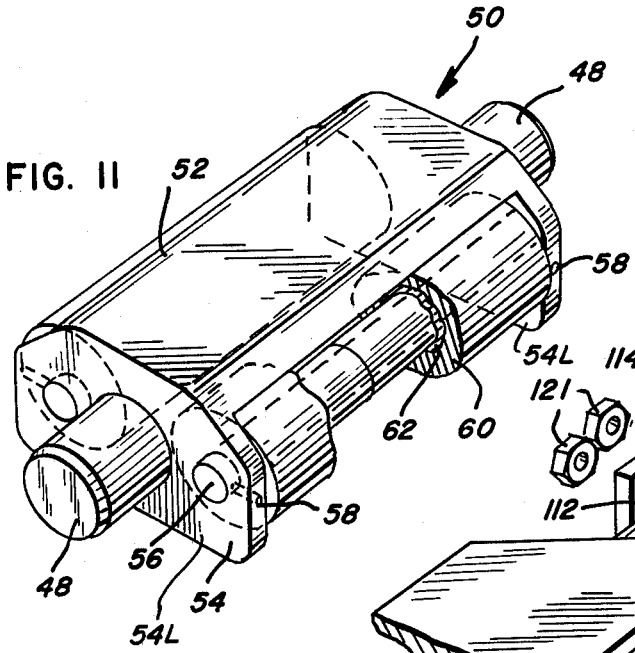
Figure 12:
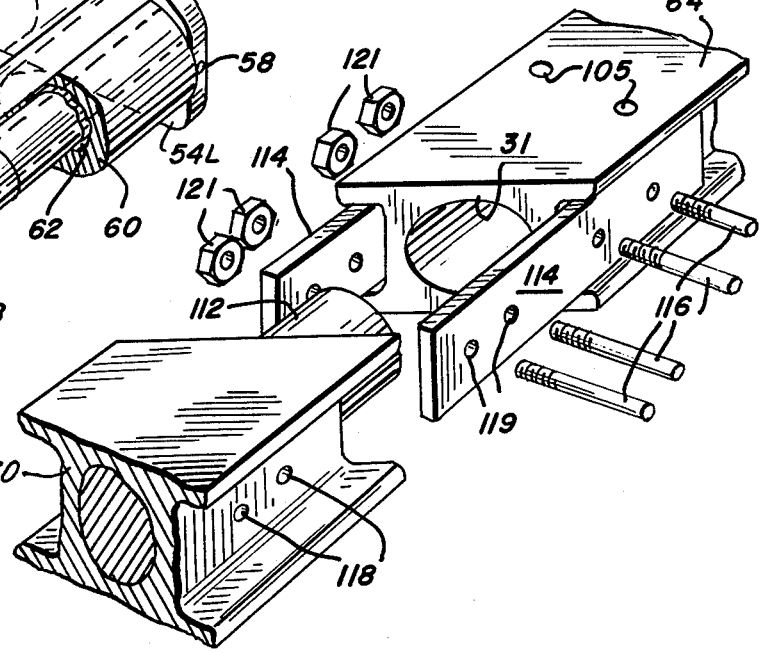

FIG. 11 is a perspective view partly broken away of a truck employed for purposes of supporting the jack-supporting carriage of the provided rerailing system; and FIG. 12 is a fragmentary perspective view partly broken away, illustrating the manner in which bridge members employed in the provided rerailing system may be butted end-to-end for purposes of providing an elongate surface over which a jack supporting carriage may move.

Figure 1:
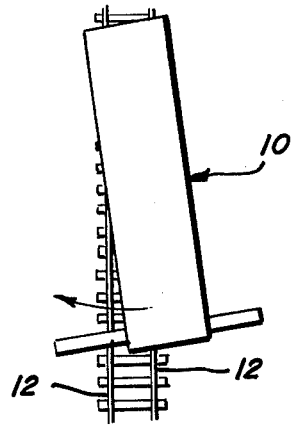
FIG. 1 is a somewhat schematic top plan view depicting a narrow illustrative of the angular path followed by a derailed railway vehicle end portion in the course of being moved back onto rail members by the provided apparatus of this invention.

Referring now more particularly to FIG. 1, a top plan view of a derailed railway car 10 is illustrated in which the lower end of car 10 as seen in FIG. 1 has been derailed from the rails 12. It will be noted from FIG. 1 that in the course of returning the lower car end to the rails 12, it is necessary that the same be elevated and moved in the direction of the rails 12 and over the rail members so that the derailed wheels may be lowered into engagement therewith.

It will be further noted from FIG. 1 that in the course of being pivoted back onto the track, the derailed car end traverses an arcuate path. Assuming that the railway vehicle has a length of approximately 50 feet, the supporting lifting jack member disposed beneath the derailed car end portion must be capable of traversing a short distance of a few inches parallel to the rail members while simultaneously carrying the derailed car portion transversely to the rail members for rerailing purposes. If an accommodation is not made for such lateral movement of the supporting jack member, the result will be side-loading of the jack piston supporting the derailed vehicle end portion. Such side loading could result in damage to the jack cylinder wall, and in extreme cases, bending of the piston rod or toppling of the jack member may result if the force component tending to move the jack along the lengths of the rail members is sufficiently great.

Figure 2:
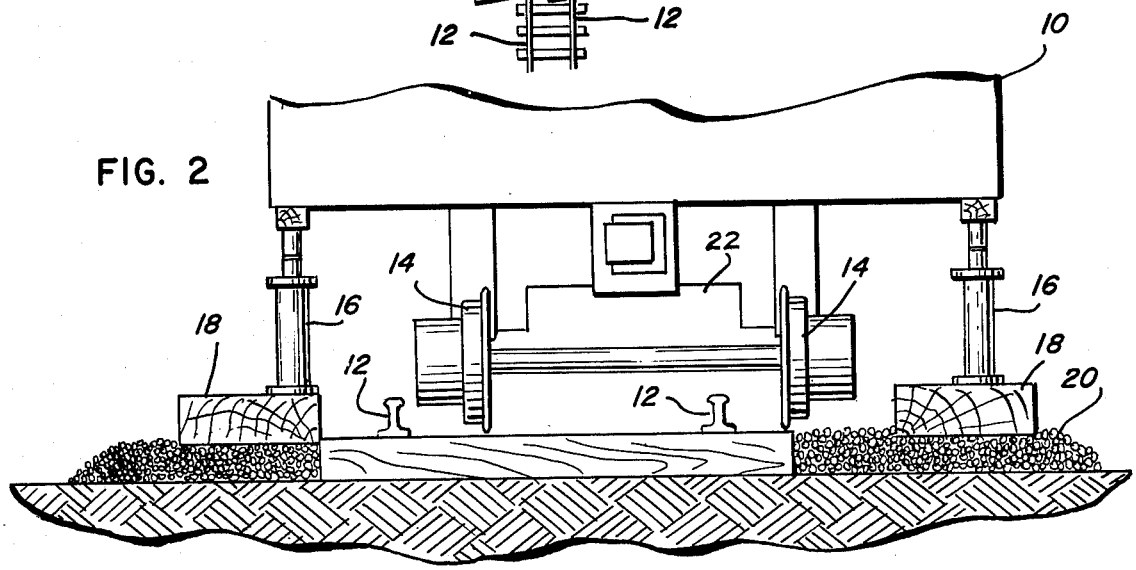
FIG. 2 is a fragmentary elevational view illustrating a derailed railway vehicle end after leveling of the same prior to being moved back onto adjacent rails by the provided apparatus hereinafter described in detail.

FIG. 2 illustrates the initial step in the course of returning derailed car 10 of FIG. 1 onto the rail members 12. Prior to lateral movement of the car wheels 14 over and above the rails 12, the car 10 must be placed in a horizontal position, as illustrated in FIG. 2, by means such as illustrated leveling jacks 16. It will be noted from FIG. 2 that the leveling jacks 16 are firmly based on timbers 18 or equivalent level base means so as to rigidly support the leveling jacks 16 and prevent slidable movement or toppling relative to the underlying surface 20 above which the lifting cylinders are disposed. With the car 10 in the level position of FIGS. 1 and 2, derailed car truck 22, which includes the derailed wheels 14, is secured to the car center sill 26 by means of chain 28 so that upon raising the car 10 above the level of the rails 12, the truck and wheels may be elevated together with the overlying derailed car portion.

The basic components of the provided rerailing system comprises a bridge 30, which may be formed in standard lengths such as seven foot lengths, and formed of a lightweight, high strength material such as an alloyed aluminum composition. By way of example, such a 7-foot bridge length having a height of approximately seven inches has a weight of approximately 200 pounds, a weight which enables the same to be readily placed into position by two workmen with the assistance of handles 32, illustrated in FIG. 3. The bridge 30 is preferably formed by extrusion for superior strength characteristics and has a circular central passageway which is adapted to facilitate joining of adjacent bridge lengths in a manner which will hereinafter be described in greater detail.

The bridge 30 provides a support surface over which a traveling carriage 34 supporting a rerailing cylinder or lifting jack 36 may carry the lifted derailed vehicle end in the course of moving the derailed wheels 14 into overlying relationship with the underlying rails 12. Thereafter the piston of the rerailing cylinder 36 is lowered to return the wheels to their respective rails. The carriage 34 is moved over smooth upper surface 64 of bridge 30 by means of traversing piston and cylinder unit 38 mounted on bracket 40 which is clamped, bolted or otherwise secured to the bridge 30, see FIGS. 6 and 8.

Figure 3:
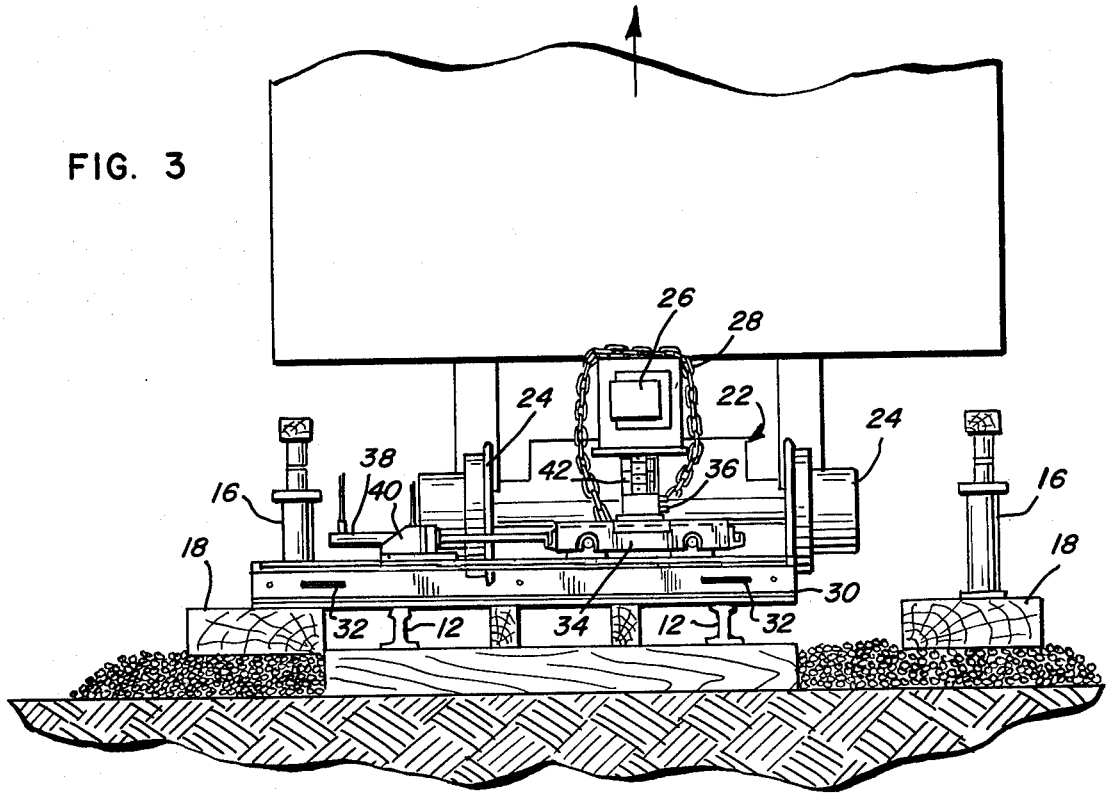
FIG. 3 is a fragmentary elevational view similar to FIG. 2 illustrating the railway vehicle end illustrated in FIG. 2 in the process of being moved by the provided apparatus into overlying relationship with adjacent rail members prior to being rerailed.
Figure 4:
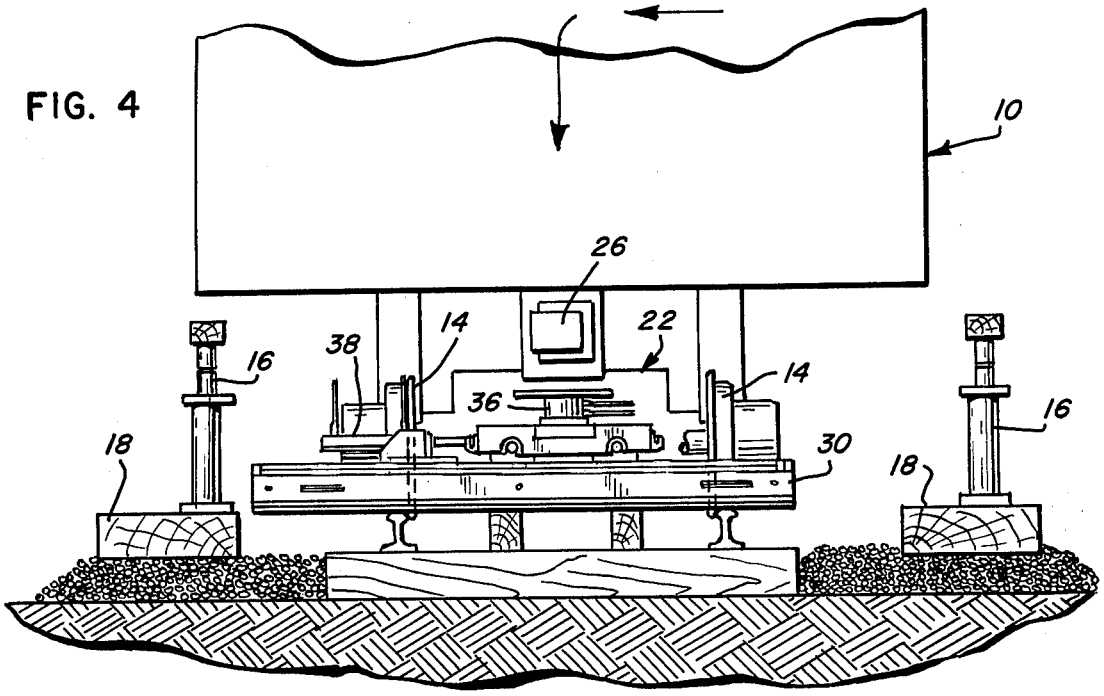
FIG. 4 is a fragmentary elevational view similar to FIGS. 2 and 3 illustrating a derailed rail vehicle end in the process of being lowered onto the rails from which initially derailed.

Following movement of the derailed car from the position of FIG. 3 to the position of FIG. 4, the piston of the rerailing cylinder 36 is lowered until the wheels 14 again engage underlying rails 12 in the manner illustrated in FIG. 4. Cylinder 36 effects a lifting movement of the overlying derailed car portion with the assistance of shoring blocks 42 in a manner which will also be described hereinafter in greater detail.

Figures 6, 7, 8:
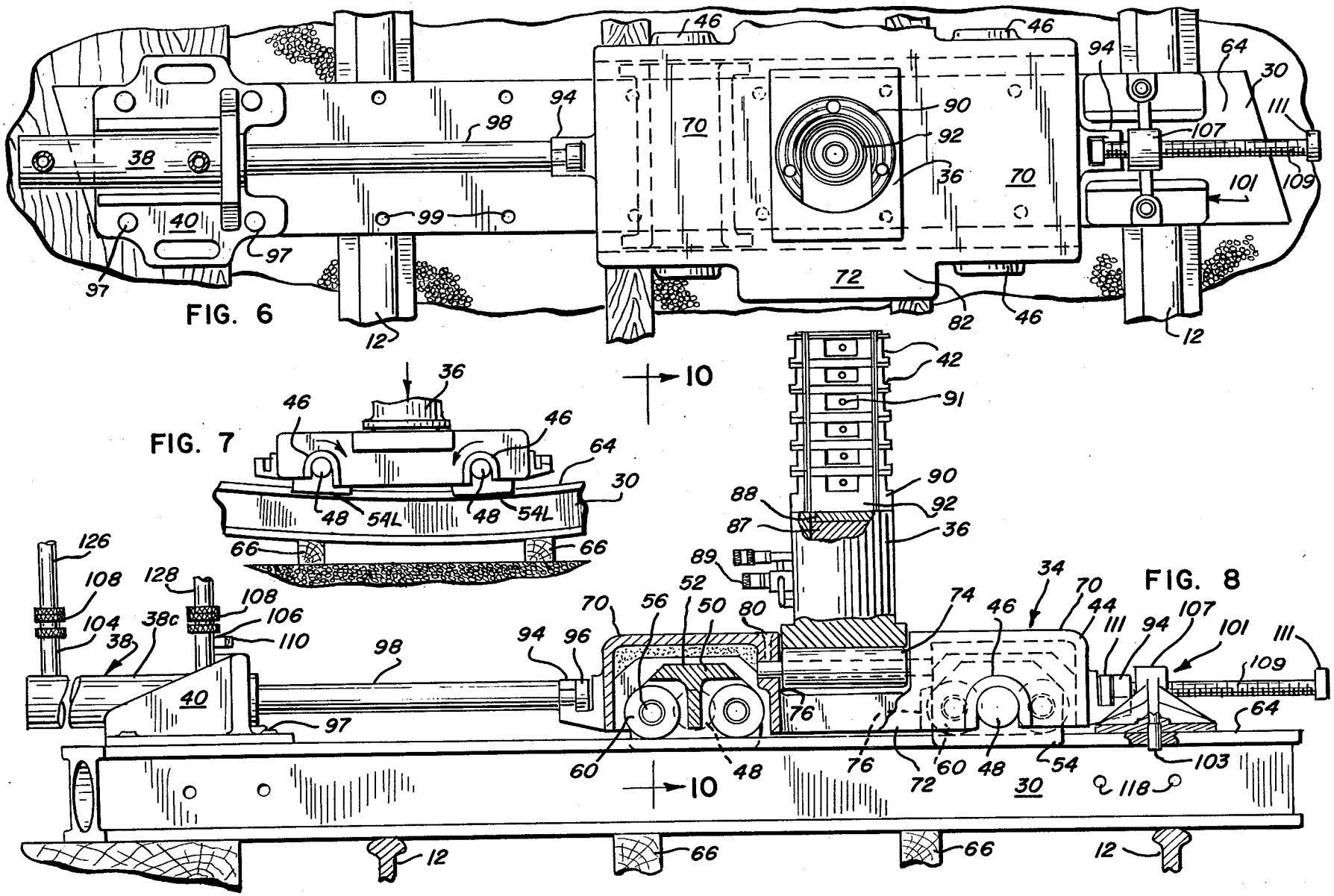
FIG. 6 is a top plan view of apparatus elements employed in one embodiment of the provided rerailing system.
FIG. 7 is a fragmentary elevational view illustrating a pivotal carriage member employed in one embodiment of the provided rerailing system.
FIG. 8 is a side elevational view, partly in section and partly broken away of the apparatus illustrated in FIG. 6.
Figure 10:
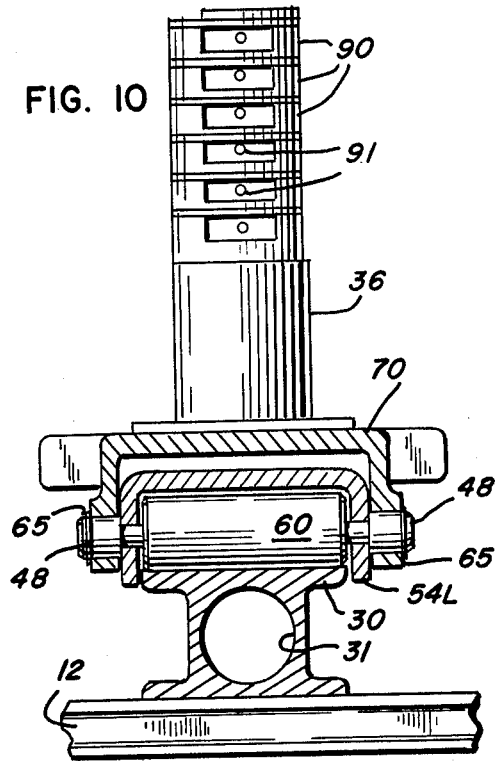
FIG. 10 is an elevational view, partly in section, taken along line 10—10 of FIG. 8.

The carriage provided in the rerailing system of this invention is seen in greater detail in FIGS. 6 and 8. It will be noted from FIG. 8 that the carriage comprises an integral aluminum casting 44 having opposed open-sided portions 46 disposed on opposed carriage sides and at opposed end portions thereof, see FIGS. 6 and 7. The integral casting construction eliminates weaknesses caused by connected components and results in superior strength. The four open-sided collar-like portions 46 of the integral carriage casting 34 are adapted to be supported on opposed non-rotating shaft stubs 48 of twin carriage trucks 50, one of which is illustrated in perspective view in FIG. 11 of the drawing. It will be noted from FIG. 11 that each truck 50 comprises a body shell or frame portion 52 having opposed side wall portions 54 in which roller pins 56 are fixedly secured in place to the shell side walls by means of locking screws 58 or the like. The roller pin 56 of each truck 50 engages an aluminum roller 60 having a central bushing 62 which may be of bronze or other suitable material. The bushing and roller rotatably move relative to the roller pin 56 in the course of truck and carriage movement over upper surface 64 of the extruded aluminum bridge 30. Snap rings 65 (see FIG. 10) may be employed about the exposed protruding peripheries of shaft stubs 48 to desirably locate the trucks relative to the supported carriage in the normal course of use.

It will be noted from FIG. 8 that each truck side wall 54, when in the normal position of use on the bridge 30, depends below the upper surface 64 of the bridge. Since as will be noted from FIG. 10, the interval between the side wall portions 54 is such as to receive the width of the bridge surface 64 therebetween with a small clearance at either side, lower end limits 54L of the truck side walls 54 serve as guides insuring axial movement of the carriage 34 and supporting trucks 50 in the course of moving over bridge upper surface 64.

It will be apparent from the various figures of the drawing that the integral aluminum carriage casting 34 is readily mounted on the bridge 30 by disposing the trucks in proper spaced relation on upper surface 64 of the bridge 30 whereafter the carriage 34 may be easily deposited upon the shaft stubs 48 integrally formed with side walls 54 of the truck body shells 52, the carriage 34 engaging the shaft stubs 48 by means of collars 46 in the manner most clearly seen in FIGS. 7 and 8 of the drawing.

In FIG. 7 the ability of the individual carriage-supporting trucks 50 to pivot independently relative to the carriage body 34 is illustrated. Inasmuch as the provided rerailing system is adapted to support the heaviest locomotive having a weight of approximately 270 tons, the carriage and bridge 30 are therefore adapted to support a load of approximately 135 tons, that is, half the weight of the derailed railway vehicle having one end resting on the rails or other support surface. Accordingly, although the bridge sections such as illustrated bridge section 30 in FIG. 8 are normally disposed atop the rail members 12, when an exceedingly heavy derailed vehicle is in the process of being rerailed, additional shoring members 66 illustrated in FIG. 8 may be employed to prevent aluminum bridge member 30 from sagging.

FIG. 7 illustrates a bridge 30 in an exaggerated sagging condition between the two supports 66. It will be noted that each of the trucks 50 may pivot relative to collars 46 of the carriage body 34. Rollers 60 of the spaced trucks will all engage upper surface 64 of the illustrated bridge segment despite the fact that the upper surface 64 is in a non-planar condition, as illustrated. The ability of the individual truck 50 to pivot relative to the carriage body 34 is therefore an advantage in the event there is some sagging of the supporting bridge member, as when exceedingly heavy loads are supported. In the absence of the pivoting ability of the supporting trucks, sagging of a bridge surface could result in the disengagement of at least one of the supporting roller members of the carriage assembly from the surface 64 of the bridge.

The supporting truck rollers 60 preferably have the outer surfaces thereof hard-coated by subjecting the same to an annodizing process in which an outer hardened shell or surface approximately 0.002 to 0.005 inch in thickness results, such hardened surfaces provide greater wearability of the rollers in the normal course of use and have a hardness of 75 on the Rockwell C Scale. It should be noted that although the aluminum rollers 60 and surface 64 of the bridge 30 effect a certain deformation or "give" in the course of a supported load being moved over the bridge surface 64 by means of the illustrated carriage 34 of the drawing, such flexing of the rollers and bridge surface enables a greater area of contact to be effected than if the roller and surface were composed of hardened steel. Accordingly, the use of the aluminum components provides a greater area of contact and a spreading of the supported load over a greater supporting surface area than if an inflexible surface and roller were employed.

Figure 9:
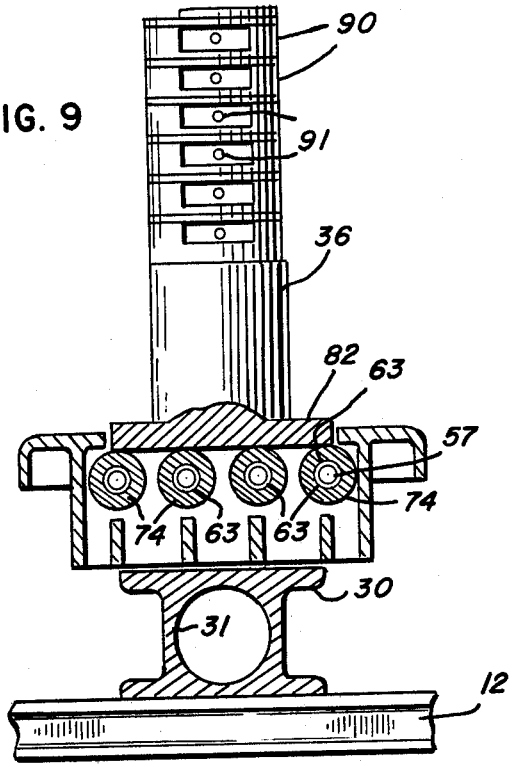
FIG. 9 is a sectional view through the carriage supporting rollers illustrating the overlying jack and shoring blocks in elevation.

It will be noted from FIGS. 6 and 8 that carriage 34 comprises spaced end portions 70 which serve to house the underlying supporting trucks 50 between which is disposed a central support section 72 comprising roller members 74 mounted in opposed side wall portions 76 defining the adjacent wall portions of the end housings 70. It will be noted from FIG. 9 that the central supporting section of the carriage comprises four rollers 74 having a construction similar to the truck rollers 60 having inner bronze bushings 63 which rotatably move relative to fixed roller pins 57, the ends of the roller pins 57 being locked in nonrotatable condition by locking screws 80 threadedly mounted in opposed wall portions 76 of the carriage housings 70 in the manner most clearly seen in FIG. 9. It will be noted from FIG. 9 that mounted atop the upper surfaces of the rollers 74 is rerailing cylinder or lifting jack 36 having base portion 82 which, as will be most clearly seen from FIG. 8, is supported by the rollers 74 at a level below the upper surfaces of the opposed housing portions 70. It will be further noted from FIG. 8 that the width of the cylinder base 82 is received between the adjacent opposed wall portions 76 of the housing portions 70 of the carriage 34, although not in contact therewith, so that the opposed upper wall portions may serve as guides if necessary in guiding the cylinder base 82 in the course of cylinder movement over the rollers 74 of the carriage 34.

The rerailing cylinder 36 comprises a step-up jack having a capacity of 135 tons in which piston rod 87 and an underlying piston portion (not illustrated) have a relatively short stroke such as a 3-inch stroke. A steel load cap 88 is disposed at the rod distal end limit (see FIG. 8) which cap initially engages the center sill of the derailed car to be rerailed for elevating purposes. Subsequently, hydraulic pressure is pumped into the rerailing cylinder 36 through a coupling connector 89 forcing rod 87 and the attached load cap 88 to extend from the cylinder 36, lifting the overlying car approximately 3 inches. In the elevated position, a U-ring 90 is disposed atop the upper surface of the jack 36 allowing the rod 87 and load cap 88 to retract toward the cylinder 36 and a central pressure pad 92 to be inserted in the U-shaped opening of the U-ring 90 in the manner indicated in FIG. 8 of the drawing. Thus, the lifting jack load cap 88 may engage the undersurface of the inserted pressure pad 92 for purposes of lifting the pad 92 and overlying derailed car sill an additional three inches, whereafter an additional U-shaped ring 90 and an additional pressure pad 92 are inserted once again for purposes of creating a series of shoring blocks comprising the U-rings and pressure pads until the car is raised the desired distance in the manner illustrated in FIG. 3 of the drawing. FIG. 8 of the drawing illustrates the rerailing cylinder 36 with six shoring blocks comprising the U-members 90 and centrally-disposed pressure pads 92 in stacked relationship over supporting cylinder 36. The rings 90 have apertures 91 formed in flat surface portions thereof (see FIGS. 9 and 10) for engaging the end of a positioning rod (not illustrated) which enables a workman to position the rings in desired position while standing at a safe distance from the supported car. Pads 92 also have rod-engaging apertures 91 formed therein as seen in FIG. 8. Rings 90 and pads 92 may comprise aluminum alloy bodies having opposed faces of hardened steel for improved wearability.

After the derailed railway vehicle has been elevated to the desired elevation by means of the lifting jack with the assistance of the shoring blocks comprising ring-pad assemblies, traversing piston and cylinder unit 38 may be energized for purposes of moving the carriage 34 and its supported load over the upper surface 64 of the bridge 30 in the course of returning the derailed wheels of the supported vehicle into overlying relationship with the rails to which the wheels are to be returned. The traversing piston and cylinder unit 38 engages collar portion 94 integrally formed with the carriage casting 34 by means of load cap 96 affixed to the end limit of extensible rod 98 reciprocally movable in cylinder **38*c* of the unit 38. Hydraulic fluid enters and exits cylinder 38*c* by means of hose conduits 126 and 128 which engage nipples 104 and 106, respectively, of the cylinder 38*c* by means of quick disconnect couplings 108. The hoses and cylinder nipples may be color-coded as well as pedeterminately threaded so as to insure proper hose connections. A relief valve 110 is disposed in nipple 106 in the event that the hydraulic liquid in hose 128 has difficulty in returning to the cylinder 38. Since the hydraulic liquid in the process of returning to the cylinder may be under greater pressure than when extending the rod in the rerailing cylinder 36, relief valve 110 may be set to open at a predetermined pressure so as to eliminate the possibility of rupturing hose 128. A derailed vehicle may be moved by carriage 34 with piston rod 87 and load cap 88 in the extended sill-engaging position. Thus, any torque imparted to the load cap 88 by the supported car will in the course of moving over the bridge be readily reacted to by the rod 87 supported in the cylinder 36** on a film of hydraulic fluid.

It will be noted from FIG. 8 that the coupling collar portions 94 are disposed at either end limit of the carriage 34 and, accordingly, the mounting brackets 40 may be disposed on either side of the carriage 34 in the course of returning the derailed vehicle to desired position over the rails. Mounting bracket 40 for the traversing piston and cylinder unit 38 may be moved in increments along the length of the bridge 30 in the event the carriage must traverse a distance greater than the stroke of the piston rod 98 in the piston and cylinder unit 38. Thus, the bracket 40 may be relocated along the length of a plurality of bridge sections laid end to end by means of securing bolts 97 being repositioned in bridge apertures 99 disposed in the surface of the bridge 30 as seen in FIGS. 6 and 8.

During such bracket relocation care must be exercised to insure the absence of carriage movement over bridge 30 while supporting car 10. Such uncontrolled carriage movement could result in damage to the supported car and supporting jack if the unrestrained carriage were to run so freely along the bridge as to topple the supported car. Accordingly, anchoring bracket 101 is provided (see FIGS. 6 and 8) having projecting foot portions 103 adapted to interfit in apertures 105 (FIG. 12) which may be located at appropriate intervals in surface 64 of bridge 30. Bracket 101 has a central internally threaded collar 107 adapted to engage the threaded length of locking screw 109. Affixed, as by pins or the like, to opposed ends of screw 109 are collars 111 adapted to engage with a collar portion 94 of the carriage 34 as above described relative to the carriage piston-carriage connection.

Since the screw 109 may be extended to the necessary length to engage the carriage collar prior to anchoring the bracket 101 in place on the bridge surface, the provided anchor may be employed to advantage regardless of the carriage "stop" position while the piston and cylinder bracket 40 is moved to a new location.

In the event long distances are to be traversed by the carriage 34, bridge sections 30 may be butted end to end and secured together by the means shown in FIG. 12. It will be noted from FIG. 12, as well as FIG. 6 of the drawing, that the opposed ends of the bridge sections are cut on the bias so that when supporting rollers 60 of the trucks 50 move thereover, the rollers will only engage a point contact at the seam between the bridge sections, thereby maintaining relative stability between the butting sections.

It will be further noted from FIG. 12 of the drawing that bridge sections 30 having central openings 31 as a result of an extrusion forming process, receive interconnecting plug 112 in such central opening 31 to rigidify the juncture between the two bridge sections. The openings 31 resulting from the extrusion process may be finished as by grinding or the like to insure a desired snug engagement with plug 112. In addition, interconnecting aluminum plates 114 may be employed having bolts 116 traversing the same by means of apertures 118 disposed in the bridge sections adjacent their end portions and plate apertures 119. The latter elements assist in effecting a rigid interconnection between adjacent bridge sections. The bolts 116 also traverse the interconnecting plugs 112 and are secured in a rigid assembly with the assistance of nuts 121. Piston and cylinder unit 38 may either push or pull the carriage 34 over the upper surface 64 of the illustrated bridge section.

Figure 5:
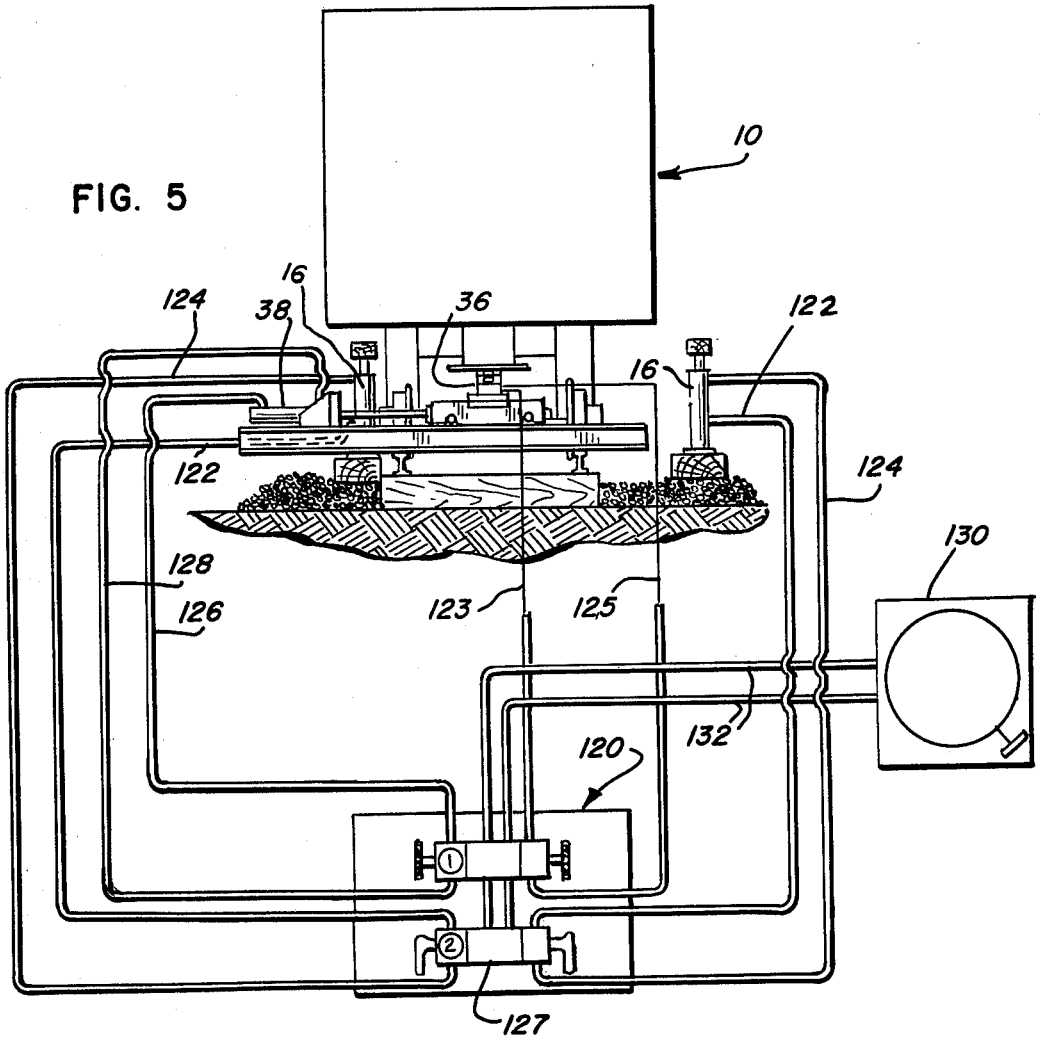
FIG. 5 is a schematic view illustrating the connections whereby hydraulic fluid passes to the various jack elements employed in one embodiment of the provided rerailing system.

FIG. 5 comprises a schematic representation of the hydraulic fluid flow taking place in the course of a normal rerailing operation using the apparatus previously described. It will be seen from FIG. 5 that the power or motive apparatus is rather simple in details of construction and comprises a console 120 from which hydraulic fluid passes by means of hose 123 to rerailing expander 36 for rod-elevating purposes; the fluid returns to the console 120 from cylinder 36 by means of hose 125. Hoses 122 extending from manifold 127 are employed for elevating the piston members in leveling or "outrigger" clyinders 16, the hydraulic fluid returning to the console 120 by means of return lines 124. Hydraulic fluid for the traversing piston and cylinder unit 38 enters the unit through hose 126 and exits cylinder **38*c* by means of line 128. Gasoline-powered pump unit 130 generates the pressure in the hydraulic fluid passing to the leveling cylinders and traversing cylinder, being connected to the console 120 by means of hoses 132**.

By way of specific example, the rerailing cylinder 36 is a step-type jack of the type sold by Templeton, Kenly & Company of Broadview, Ill. in a rerailing package including stacking rings, pressure pads and an insulation rod. Each of the leveling or outrigger cylinders preferably has a capacity of about 100 tons, and the traversing unit 38 may either push or pull the carriage and has a push capacity of about 25 tons and a pull capacity of approximately 10 tons.

A gasoline-powered pump which may be employed for creating hydraulic pressure in the rerailing system is sold by Templeton, Kenly & Company under the trademark CHARGER and employs a 7-hp. engine capable of generating 3600 rpm.

It is apparent from the foregoing, therefore, that in the course of moving the derailed end of a railway vehicle such as car 10 illustrated in FIG. 1, such car in the course of being moved from the position of FIG. 2 of the drawing into the position of FIG. 4 of the drawing traverses an arcuate path indicated by the arc in FIG. 1 of the drawing. Such arcuate path necessitates a lateral movement of the rerailing cylinder 36, U-rings 90 and pressure pads 92 as the derailed end of the car moves through its arcuate path. During the lateral movement the cylinder 36 must be moved over roller members 74. Since base 82 of the lifting cylinder 36 is of rectilinear peripheral configuration, it may be guided at opposed longitudinal edges by upper portions of carriage walls 76 during cylinder movement over rollers 74. The frictional resistance afforded the cylinder 36 by the rollers 74 is extremely small and, accordingly, the force exerted on the rerailing cylinder 36 by the derailed car resulting in lateral movement of the cylinder in the channel defined by the opposed walls 76 of the carriage is extremely small. A coefficient of friction of approximately 0.05 results between the cylinder 36 and the roller members 74.

The provided rerailing system, therefore, comprises a lightweight system composed of readily movable parts which are able to be handled by two workmen in the field and set in place for a rerailing operation without the necessity of employing a separate power source for purposes of creating necessary hydraulic pressure or other moving force. Although the foregoing relates to a vehicle which has been derailed at one end only, it is apparent from the foregoing description that the provided apparatus may be employed for returning both ends of a car to the rails. The distance of the car from the rails may necessitate alternate movement of the opposed car ends in the course of approaching the rails. As above noted, in the course of moving one end of a derailed car, the opposed end should be blocked in place so as to prevent movement thereof.

The provided system is complete in and of itself requiring no external power source or the like. The entire system may be readily brought to a necessary site for rerailing purposes and following use, may be readily removed from such site necessitating a minimum of operating time and labor. The described system may be maintained in desired operating condition with a minimum expenditure of maintenance time.

It is seen from the foregoing, therefore, that various modifications may be made in accordance with the teachings of this invention and, accordingly, this invention is to be limited only by the scope of the appended claims.

What is claimed is:

1. In a rerailing system for pivotally moving one end of a derailed vehicle through a large arc about an opposed vehicle end the combination comprising a support surface; a carriage axially movable along said support surface; parallel support rollers mounted for ready rotation on said carriage; upper peripheral surface portions of said rollers lying in substantially the same plane in the normal course of system use; means connected to said carriage for controlled axial movement of said carriage along said support surface, and lifting means for supportably engaging a derailed railway vehicle; said lifting means being mounted on said support rollers for movement thereover transversely to the direction of carriage movement; said rollers defining a path for said lifting means along which such transverse movement of said lifting means is effected; the frictional resistance afforded by said support rollers to movement of said lifting means thereover being such that force components imparted by a supported derailed car moving said lifting means over said rollers along an axis transversely to said direction of carriage movement effect movement of said lifting means over said rollers, simultaneously as said carriage means moves axially along said direction of carriage movement, whereby said lifting means and supported vehicle end traverse such large arc resulting from simultaneous movement thereof along axial paths parallel and transversely to the carriage direction of movement and wherein any rotary movement induced in the rerailing system occurs in the lifting means itself and not between the lifting means and the carriage.

2. The system of claim 1 in combination with means detachably mountable on said support surface and having a connecting portion for engaging said carriage and anchoring said carriage relative to said support surface.

3. The system of claim 2 in which said connecting portion comprises a retractable screw extendible from a threaded opening disposed in the detachably mounted means.

4. The system of claim 3 in which the detachably mounted means has a base portion adapted to rest on said support surface in the normal course of system use, and projecting pins extending from said base portion adapted to interfit with openings disposed in said support surface.

5. The rerailing system of claim 1 in which said carriage means has depending side wall portions depending below the plane of the carriage support surface which portions comprise guides preventing movement of said carriage means transversely to the direction of carriage axial movement over said support surface.

6. The rerailing system of claim 1 in which said coefficient of friction resisting movement of said lifting means over said rollers is of the order of 0.05.

7. In a rerailing system for rerailing a derailed vehicle the combination comprising smooth-surfaced support means, carriage means axially movable over said smooth-surfaced support means; roller means mounted on said carriage means having axes of rotation substantially parallel to the axis of movement of said carriage means; lifting means comprising a piston rod for engaging a derailed vehicle extendable from a cylinder body containing hydraulic fluid disposed on said roller means and supported in substantially the horizontal plane for movement with said carriage means during movement over said support means; said lifting means having a proximal end supported in a hydraulic fluid body in said cylinder said lifting means being simultaneously movable over said roller means transversely to said axis of movement of said carriage means upon the exertion of a force component on said lifting means transversely to said direction of carriage means axial movement as said carriage means moves over said support means which is of the order of 0.05 of the force applied to said rollers through said lifting means; whereby a derailed vehicle portion directly supported by said lifting means piston rod in the extended position traverses an arcuate path as said lifting means simultaneously moves along two straight-line axes; torsion forces imparted to said piston rod in the extended vehicle supporting position resulting only in the rotational movement of the extended rod in the cylinder body.

8. In a rerailing system for pivotally moving one end of a derailed vehicle through a large arc about an opposed vehicle end the combination comprising means for leveling one end of a derailed vehicle having derailed wheels therebeneath; bridge means having opposed parallel lateral edges extending in the interval between the derailed vehicle wheels and the rails to which such wheels are to be returned; carriage means movable along the axis of said bridge means; lifting means mounted on said carriage means for lifting the leveled vehicle end; motive means for moving said carriage and lifting means while supporting said leveled vehicle end along the bridge means longitudinal axis; guide means on said carriage means cooperating with said bridge means for guiding said carriage means along the axis of said bridge means and preventing carriage movement transversely to the bridge means longitudinal axis; said guide means comprising opposed depending flanges of said carriage means disposed adjacent opposed lateral edges of said bridge means; roller means mounted on said carriage means permitting movement of said lifting means in a direction transversely to the direction of carriage means movement as said carriage means moves along said bridge whereby said derailed vehicle end supported by said carriage means is arcuately moved as said lifting means simultaneously moves along axes both parallel and transversely to the bridge means and wherein any rotary movement induced in the rerailing system occurs in the lifting means itself and not between the lifting means and the carriage axis in the course of moving over said bridge means; said carriage means having spaced parallel walls defining a transverse channel disposed along the path of said lifting means transverse movement; said roller means defining the bottom of said channel; said lifting means being disposed in adjacent relation with said spaced walls in the normal course apparatus use; the coefficient of friction resisting movement of said lifting means over said rollers being of the order of 0.05.

9. The apparatus of claim 8 in which said motive means comprises at least one piston and cylinder unit mountable at spaced locations along the length of said bridge means.

10. The apparatus of claim 8 in which said carriage means has depending guide portions disposed adjacent opposed edge portions of said bridge means for guiding said carriage means along the axis of said bridge means in the course of moving thereover.

11. The apparatus of claim 8 in which said roller means permitting movement of said lifting means in a direction transversely to the bridge axis comprises a plurality of aluminum rollers having bronze bushings rotatably and supportably mounted on fixed roller pins arranged on said carriage means parallel to the bridge longitudinal axis.

12. In a rerailing system the combination comprising smooth-surfaced support means, carriage means axially movable over said smooth-surfaced support means; roller means mounted on said carriage means having axes of rotation substantially parallel to the axis of movement of said carriage means; said carriage means comprising a carriage body having said roller means substantially centrally mounted thereon; support trucks in underlying supporting engagement with opposed ends of said carriage body; each of said trucks comprising a frame in which spaced rollers are rotatably mounted for movement over said support means; the central portion of each of said truck frames having transverse shaft portions extending therefrom and adapted to be pivotally mounted in said opposed ends of said carriage body whereby each of said truck frames and the rollers mounted thereon may pivot independently relative to said carriage body and the opposed truck; open sided collars on said carriage body for receiving said shaft portions of said truck frame whereby said carriage body may be directly lifted from said trucks during truck-carriage body disassembly and directly placed over said truck frame shaft portions in the course of carriage body-truck assembly; lifting means disposed on said roller means supported in substantially the horizontal plane for movement with said carriage means during movement over said support means; said lifting means being simultaneously movable over said roller means transversely to said axis of movement of said carriage means upon the exertion of a force component on said lifting means transversely to said direction of carriage means axial movement as said carriage means moves over said support means which component is of the order of 0.05 of the force applied to said rollers through said lifting means and wherein any rotary movement induced in the rerailing system occurs in the lifting means itself and not between the lifting means and the carriage.

13. The system of claim 12 in which each of said truck frames has opposed side walls in which said truck rollers are supportably mounted; said side walls depending below the level of said smooth-surfaced support means.

14. The system of claim 13 in which each of said truck rollers comprises a hardened aluminum roller having a central bushing rotatably mounted on a central shaft locked to said frame walls.

* * * * *